US005481848A

United States Patent [19]

Tagliaferri et al.

[11] Patent Number: 5,481,848

[45] Date of Patent: Jan. 9, 1996

[54] METHOD FOR FEEDING AND PREPARING INFORMATION LEAFLETS ON A PRODUCT PACKAGING LINE AND A SYSTEM FOR IMPLEMENTING THIS METHOD

[75] Inventors: Roberto Tagliaferri, Castel S. Pietro; Franceschi Giancarlo, Budrio, both of Italy

[73] Assignee: I.M.A. Industria Macchine Automatiche S.P.A., Ozzano Emilia, Italy

[21] Appl. No.: 121,287

[22] Filed: Sep. 14, 1993

[30] Foreign Application Priority Data

Sep. 16, 1992 [IT] Italy ..... BO92A0324

[51] Int. Cl.[6] ..... B65B 35/54

[52] U.S. Cl. ..... 53/157; 53/238; 53/252

[58] Field of Search ..... 271/204, 206, 271/277; 53/117, 238, 157, 445, 378.3, 387.2, 252

[56] References Cited

U.S. PATENT DOCUMENTS 3,140,570 7/1964 Hickin ..... 53/378.3

3,982,382 9/1976 Vogel ..... 53/252

4,059,264 11/1977 Vogel ..... 53/157 X

FOREIGN PATENT DOCUMENTS 2354685 6/1977 France ..... 53/474

OTHER PUBLICATIONS

European Search Report, dated Jan. 11, 1994.

*Primary Examiner*—John Sipos

*Assistant Examiner*—Gene L. Kim

*Attorney, Agent, or Firm*—McAulay Fisher Nissen Goldberg & Kiel

[57] ABSTRACT

A method for feeding and preparing information leaflets on a product packaging line consisting of a first carton conveyor, a second product conveyor and, between these two conveyors, a leaflet continuous-grip conveyor for transporting leaflets along a conveyor aligned to the packaging lines where the leaflet conveying means have sections with varying degrees of grip to facilitate feeding and inserting of leaflets.

7 Claims, 3 Drawing Sheets

METHOD FOR FEEDING AND PREPARING INFORMATION LEAFLETS ON A PRODUCT PACKAGING LINE AND A SYSTEM FOR IMPLEMENTING THIS METHOD

BACKGROUND OF THE INVENTION

This invention consists of a method for feeding and preparing information leaflets along a product packaging line and a system for implementing this method.

DESCRIPTION OF THE PRIOR ART

In the current state of the art, automatic, continuous-movement packaging machines for packing products into cartons consist of three, closed-loop conveyors, positioned side by side, longitudinally parallel to each other and whose top surfaces are approximately coplanar. The first of these conveyors usually has guide elements for positioning pre-formed, opened cartons on the conveyor and for transporting the cartons along the packaging line so that at least the carton faces immediately adjacent to the second conveyor are open. Running alongside the first conveyor there is a second conveyor, usually of the bucket type, designed to transport single product items at an equal distance from each other and aligned with the cartons carried on the first conveyor running alongside. Alongside the second conveyor there is a third conveyor with pusher elements designed to operate across the upper plane of the packaging line and designed to push the products on the second conveyor into their respective cartons carried on the first conveyor. The cartons, products and pushers are driven and fed at the same speed longitudinally aligned along the same plane. If, in the machine configuration described above, an information leaflet (for example, describing product characteristics) is to be inserted into the carton, a fourth conveyor is positioned between the first carton conveyor and the second bucket conveyor and is equipped with gripping means which are usually of the flexible, sprung type. These sprung grippers are moved along the packaging line by the fourth conveyor and are held in position during their travel close to the outfeed of each bucket on the second conveyor; the grippers can, for example, be positioned at the bottom centre of the lower edge of the buckets so that they do not interfere with the products as these are pushed into their cartons. The grippers are opened and closed by fixed guide means positioned along the packaging line which perform the following sequence of operations. At the beginning of the packing line the grippers are open in preparation for picking up the leaflet. When the grippers reach the leaflet pick-up station, the fixed guides close the grippers so that the leaflet is gripped between the gripper prongs in a position which is usually vertical and central to the lower edge of the respective bucket. The leaflet gripped in this way is carried along the packaging line to the product cartoning station where pushers eject the product from its bucket; as the product is ejected from its bucket it meets the leaflet and carries it into the carton without interfering with the grippers. In this the product insertion phase the fixed guides open the gripper prongs to allow the leaflet to be inserted into the carton with the product. This method for inserting leaflets into cartons has several drawbacks. The first drawback is that the actuation of the gripper prongs during the leaflet pick-up phase at the leaflet pick-up station must take place in a very short time. This means that the fixed guides require very precise adjustment. Sometimes, even when the maximum of care is taken, the leaflet is not picked up or is picked up incorrectly thus leading to faults in subsequent phases. A second drawback occurs in the product insertion phase at the product cartoning station where the grippers must open exactly at the moment when the leaflet reaches the carton infeed; if the grippers are opened before this point is reached, the leaflet will drop down and be lost; if the grippers are opened after this point is reached, the leaflet will be torn by the action of the product being inserted into the carton while the leaflet is still gripped by the gripper. A further drawback of the method described above stems from the fact that the leaflet is held in an upright position between the gripper prongs and that during the product cartoning phase the leaflet must be folded into a U-shape as it is pushed into the carton. This folding action requires considerable pusher power. A faulty fold can cause jamming and an uneven fold can lead to irregular movements of the pushers and related products thus causing unwanted decelerations and accelerations in operating speeds. Yet another drawback to the above method occurs during size-changeover operations where a change in the size of the product conveyor also requires a re-adjustment of the grippers along the packing line or a complete change of all leaflet grippers to match the new size. Other shortcomings of the above method include: the noise caused as the leaflet grippers hit the fixed guides during opening and closing operations; rapid gripper wear; complicated gripper mechanisms.

SUMMARY OF THE INVENTION

The aim of the present invention is therefore to solve the shortcomings listed above by providing a method for feeding and preparing information leaflets along a product packaging line consisting of a first carton conveyor and a second product conveyor. The method is characterised by the fact that between the first carton conveyor and the second product conveyor there are means for continuously gripping and transporting leaflets designed to receive sequentially fed leaflets and convey them along a leaflet conveyor line which is aligned to the packaging line so that the leaflets are positioned in the middle between the first and second conveyors in alignment with the cartons and products; the means for conveying the leaflets along the line have a first section providing a strong grip for picking up and preparing the leaflets and a second section providing a weaker grip for inserting leaflets into cartons. The said means pre-fold the leaflets and hold them in position along the leaflet conveyor line in readiness for insertion into their respective cartons. A further aim of the present invention is to provide a system for feeding and preparing leaflets along a product packaging line consisting of a first carton conveyor and a second product conveyor where the system is characterised by the fact that it has, between the first carton conveyor and the second product conveyor, leaflet continuous-grip conveyor means consisting of two belts, one above the other, touching and longitudinally aligned; the leaflet is gripped and transported between and by the two belts forming the leaflet conveyor line aligned to the packaging line. The leaflet conveying means consist of a pair of coplanar, closed-loop belts whose inside surfaces touch along a section so as to define a leaflet conveyor line. The adherence between the belts of the leaflet conveyor line can be varied by adjusting sliding plates fitted to the belts and/or by adjusting guide pulleys. A further aim of this invention is to provide longitudinal fixed guides designed to fold leaflets and hold them in position in preparation for insertion into their cartons.

Further features and advantages of the present invention are set forth in the following detailed description, where a preferred embodiment, only illustrative, is disclosed as an example with reference to the accompanying drawings, in which:

DESCRIPTION OF THE PREFERRED EMBODIMENTS

Figure 1:
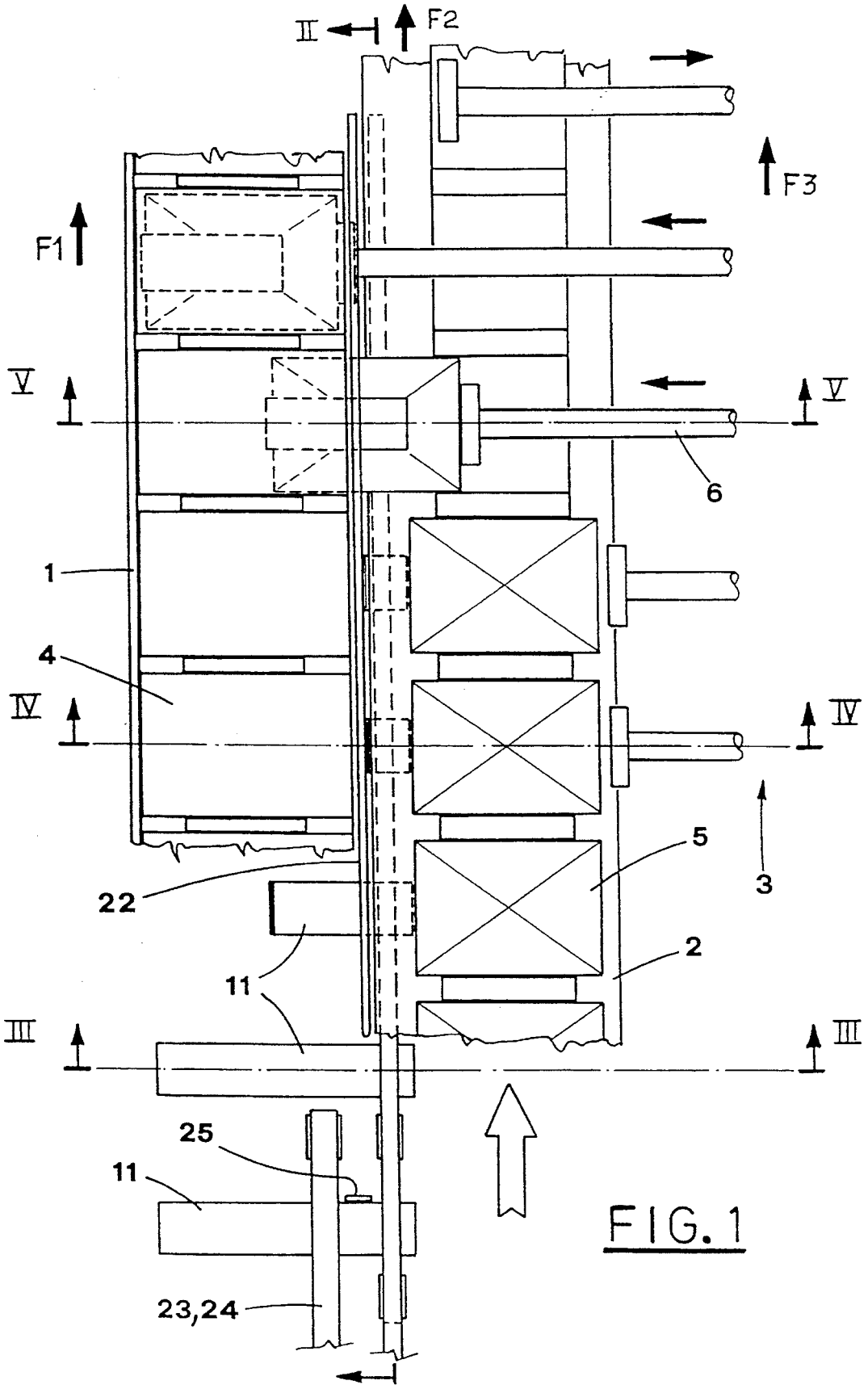
FIG. 1 is a plan view of an automatic product packaging machine according to the present invention.
Figure 2:
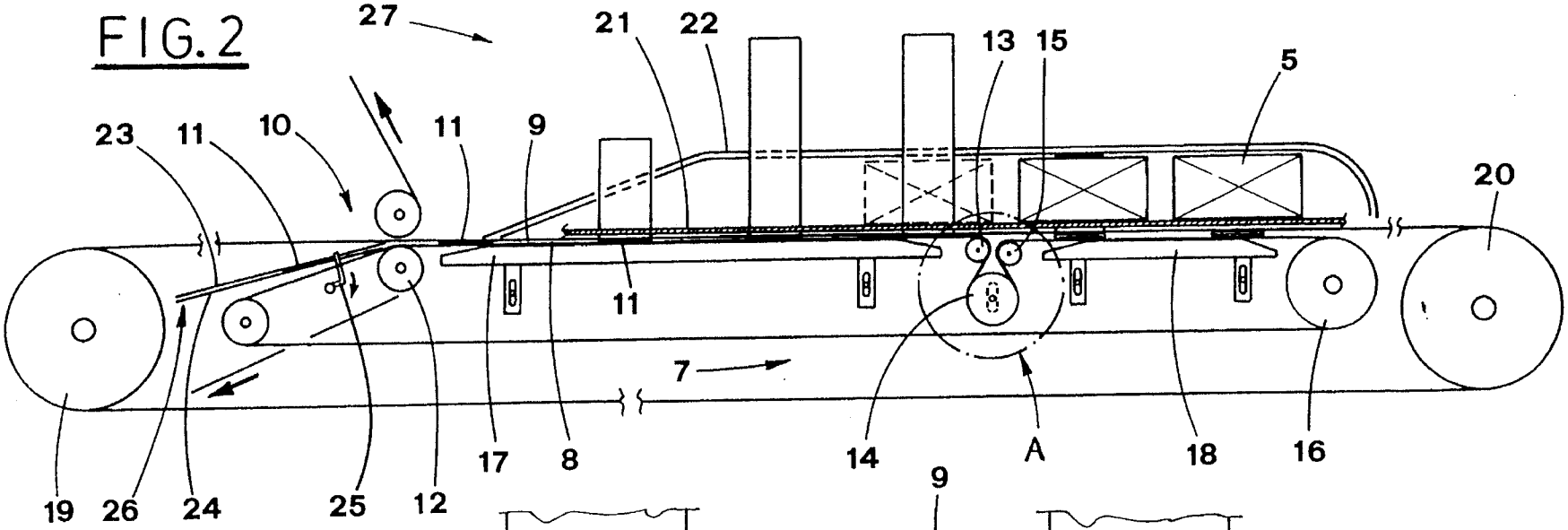
FIG. 2 is a cross-section side view of the machine shown in FIG. 1.
Figure 2A:
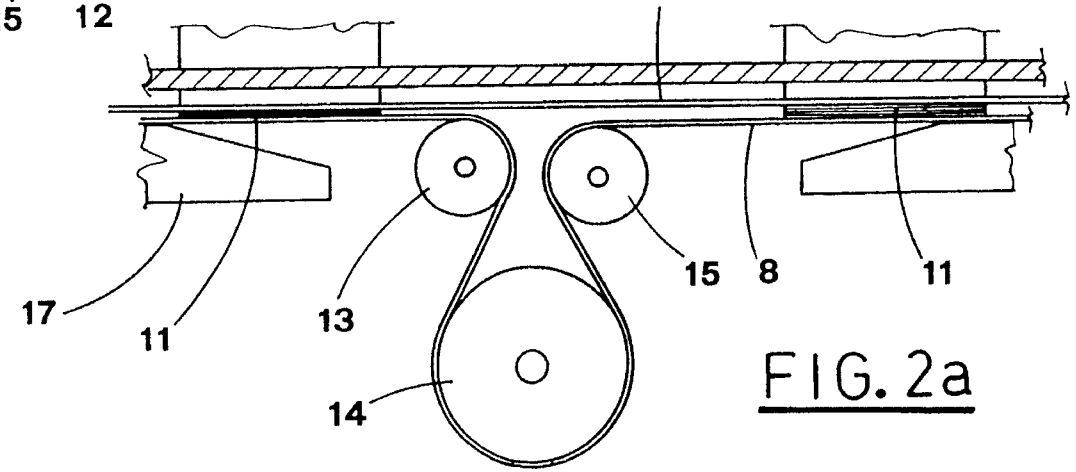
FIG. 2A is an enlarged view of the detail A in FIG 2.

FIG. 1 shows a carton conveyor 1 with pre-formed, opened cartons 4 positioned at an equal distance to each other on the conveyor 1 and transported downstream along a packaging line in the direction indicated by the arrow F1. Alongside the conveyor 1 there is a second conveyor 2 carrying the products 5 aligned and on the same plane as the cartons 4 carried by the conveyor 1; the second conveyor 2 conveys the products 5, with at least their loading side open, downstream in the direction of the arrow F2. Alongside the conveyor 2 there are product loading means 3 consisting of pusher bars 6 which move longitudinally downstream in the direction of the arrow F3.

Given that the two conveyors 1 and 2 and the product loading means 3 move at the same speed and in the same direction as each other, the crossways alignment between the cartons 2, the products 5 and the pusher bars 6 remains constant along the entire length of the packaging line. In this way the loading means 3 move the pusher bars 6 sideways pushing the products 5 from the product conveyor 2 towards the carton conveyor 1 thus inserting the products 5 into their respective cartons 4.

Between the first carton conveyor 1 and the second product conveyor 2 there are leaflet conveying means 7 consisting of two, closed-loop belts 8 and 9 driven at the same speed as the packaging line and travelling on the same vertical plane as each other. 0n the upper part of vertical path travelled by the two belts 8 and 9 the inside surfaces of the two belts touch and adhere along a section longitudinally aligned with the packaging line. This section starts close to the leaflet 11 feed means 10 and finishes downstream of the packaging lines so that the leaflets 11 can be gripped between the two belts 8 and 9 along the section and can be carried along the packaging line at any distance whatsoever thus defining a continuous-grip leaflet conveyor line 27.

The belt 8 is guided along the leaflet conveyor line 27 by the height-adjustable pulleys 12, 13, 14, 15 and 16 and is supported by a pair of slide plates 17 and 18 which are also height adjustable for the reasons outlined below.

The belt 9 is guided along the leaflet conveyor line 27 by the pulleys 19 and 20 positioned at the ends of the path travelled by the first belt 8; the upper part of this path is fitted with a slide plate 21 for the reasons outlined below.

This layout means that the contact pressure between the belt strips 8 and 9 along the leaflet conveyor line 27 can be adjusted by changing the vertical adjustment of the pulleys 12, 13, 14, 15 and 16 and/or the vertical adjustment of the plates 17 and 18 thus varying the degree of adherence between the belts along the section where the two belts 8 and 9 are on top of each other.

During operation, the adherence between the belt strips 8 and 9 along the leaflet conveyor path 27 is greater in the initial zone and lesser in the final zone for the reasons described below.

Alongside the leaflet conveyor line 27 there is a fixed guide 22 which has a low section at the start of the leaflet conveyor line 27 and which then increases in height until it exceeds carton height and remains at this height until it is downstream of the packaging line for the reasons described below.

Figure 3:
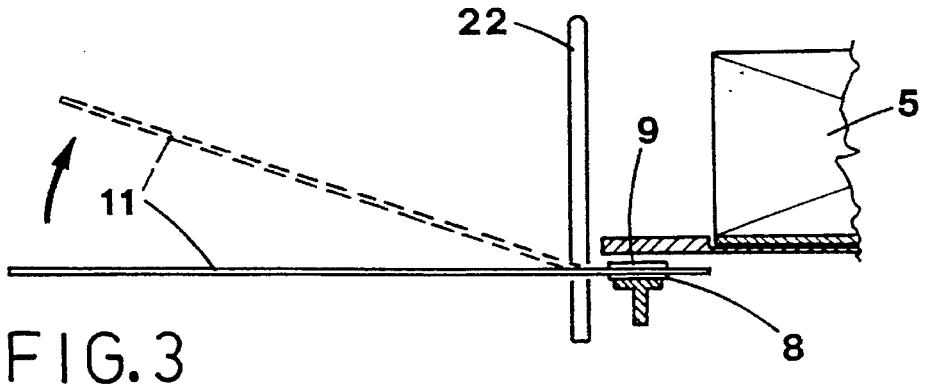
FIG. 3 is a cross-section view along the line III—III in FIG. 1.
Figure 4:
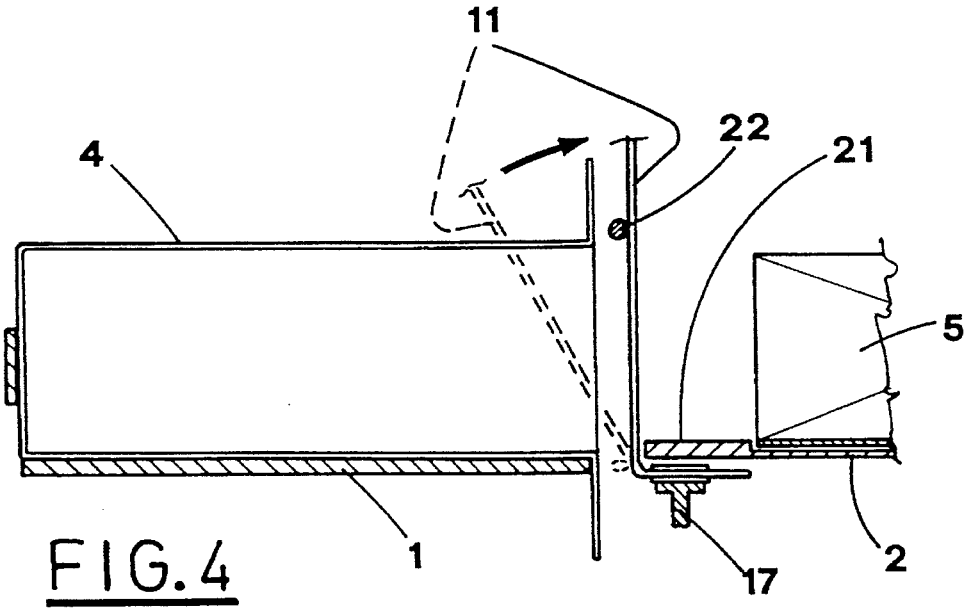
FIG. 4 is a cross-section view along the line IV—IV in FIG. 1.
Figure 5:
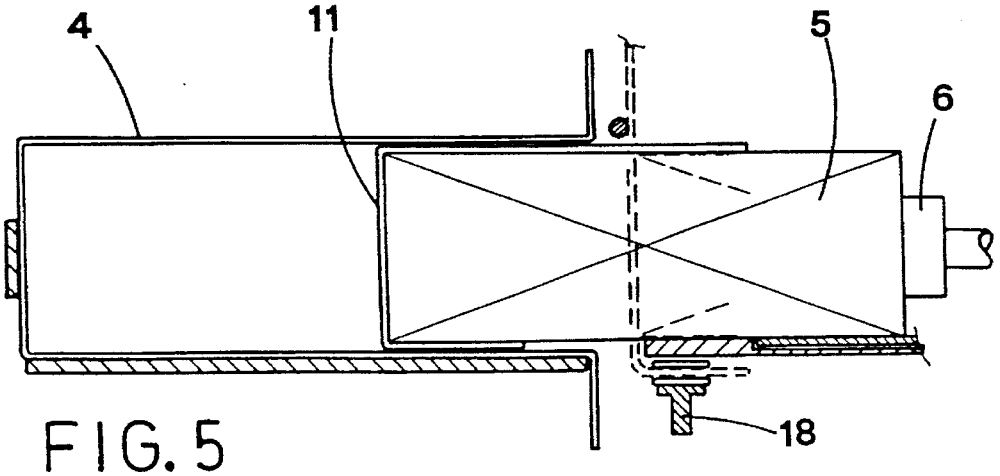
FIG. 5 is a cross-section view along the line V—V in FIG. 1.

In order to feed leaflets 11 to the leaflet conveyor line 27, the leaflet feed means 10 picks up concertina-folded leaflets 11 from a folding unit usually of the GUK type (not shown here) by means of a conveyor 26 consisting of adhering belts 23 and 24. The conveyor 26 transports the leaflets 11 through a toothed timing station 25 to the leaflet conveyor line 27 placing the leaflets between the belts 8 and 9 so that they are coplanar with the belts at the start of the leaflet conveyor line 27 ready for transport along the packaging line. The toothed timing station 25 synchronises the leaflets 11 with the cartons 4 and the products 5 carried by the conveyors 1 and 2 thus feeding or stopping the leaflets 11 along the conveyor 26 so that the conveyor 26 feeds the leaflet conveyor line 27 in synchrony with the packaging line. During operation, leaflets are fed to the leaflet conveyor line 27 by the conveyor 26 and the leaflets are fed at the required distance to each other by the timing tooth 25. The leaflets are then gripped by the leaflet conveyor line 27 and immediately afterwards released by the conveyor belt 26. The leaflets are now horizontal to the packaging line with one end gripped between the belts 8 and 9 of the leaflet conveyor line 27; along this section of the line the contact pressure between the belts 8 and 9 is very strong. The other end of the leaflet 11 is free and during its longitudinal travel meets the lower part of the fixed guide 22. The leaflet is fed forward gripped between the belts 8 and 9 while its free end is forced to rise as it travels along the sloped, rising section of the guide 22. This action forms a fold in the leaflet close to the point where the leaflet is gripped by the leaflet conveyor line (see FIG. 3). As the leaflet continues to travel downstream this fold becomes increasingly more pronounced until the free end of the leaflet meets the horizontal section of the guide means 22; at this point the leaflet has a 90° fold (see FIG. 4). Downstream from this fold, pusher means 3 using pusher bars 6 push the product 5 from the conveyor 2 in the direction of the cartons 2 on the conveyor 1. During this movement the product 5 intercepts the leaflet 11 which is currently being held in a vertical position by the horizontal guide 22 and which is travelling longitudinally held by the conveyor line 27 which, in the meantime, has reduced the contact pressure between the belts 8 and 9. In FIG. 5, the product 5 has started to be inserted into its carton 4 taking with it the leaflet 11 which can easily be inserted into the carton because its lower part is already folded and gripped with minimum pressure by the conveyor line 27.

In a second version of the invention the leaflet conveyor line still consists of a pair of belts, one above the other with the same pressure characteristics as described above, but in this version the belts are rotated through 90° (with respect to the version described above) so that the "width" of the belts 8 and 9 is vertical to the packaging line. In this second version, the leaflets 11 are positioned vertically upright along the packaging line and can be transported together with the products using the differential grip characteristics of the leaflet conveyor 27.

When a size-changeover operation is necessary, the leaflet conveyor line does not require changing and any new spacing required between one leaflet and another to match the new spacing of the cartons and products is obtained by simply adjusting the leaflet timing tooth.

The above description is intended as an example only and is in no way restrictive; any modifications thereto fall within the scope of the above description and the appended claims.

What is claimed is:

1. A product and leaflet packaging system comprising:

a carton conveyor;

a product conveyor extending parallel to said carton conveyor along at least a packaging path;

product loading means disposed along said packaging path for loading products from said product conveyor into respective cartons on said carton conveyor; and leaflet conveyor means located between said carton conveyor and said product conveyor along said packaging path for transporting leaflets adjacent to the product loading means, the leaflets being inserted into said cartons, through contact with respective products, as said products are loaded into their respective cartons by said product loading means, said leaflet conveyor means including a pair of coacting belts extending parallel to one another and to said packaging path, said belts being in contact with one another along said packaging path, whereby the leaflets are gripped and transported between and by said belts.

2. The system defined in claim 1, wherein said belts extend essentially in a common plane parallel to said carton conveyor and said product conveyor along said packaging path, further comprising means for bending a portion of each given leaflet from said plane into an essentially orthogonal plane between said carton conveyor and said product conveyor along said packaging path, while another portion of said given leaflet remains gripped by said belts in said common plane.

3. The system defined in claim 2, wherein said means for bending includes a stationary guide bar of a fixed shape.

4. The system defined in claim 1, wherein said belts are coplanar closed-loop belts having inner surfaces touching along a section so as to define a leaflet conveyor line.

5. The system defined in claim 1, further comprising a plurality of adjustable support plates fitted to said belts to enable adjustment of the adherence between said belts along said packaging path.

6. The system defined in claim 1, further comprising adjustable guide pulleys engaging said belts to enable adjustment of the adherence between said belts along said packaging path.

7. The system defined in claim 1, further comprising fixed longitudinal guide means for folding leaflets and holding them in position in preparation for insertion into respective cartons.

* * * * *